US009289038B2

(12) United States Patent
Ma

(10) Patent No.: US 9,289,038 B2
(45) Date of Patent: Mar. 22, 2016

(54) CANTILEVER UMBRELLA

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 14/490,455

(22) Filed: Sep. 18, 2014

(65) Prior Publication Data

US 2015/0075574 A1 Mar. 19, 2015

Related U.S. Application Data

(60) Provisional application No. 61/880,059, filed on Sep. 19, 2013.

(51) Int. Cl.

| | |
|---|---|
| ***A45B 25/14*** | (2006.01) |
| ***A45B 23/00*** | (2006.01) |
| ***A45B 25/08*** | (2006.01) |

(52) U.S. Cl.

CPC ..... *A45B 23/00* (2013.01); *A45B 25/08* (2013.01); *A45B 2023/0031* (2013.01); *A45B 2023/0043* (2013.01); *A45B 2023/0081* (2013.01); *A45B 2025/146* (2013.01)

(58) Field of Classification Search

CPC ..... A45B 23/00; A45B 2023/0031; A45B 2023/0037; A45B 2023/0043; A45B 2023/0075; A45B 2023/0081; A45B 25/08; A45B 25/14; A45B 2025/146; A45B 17/00; A45B 17/005; A45B 19/00

USPC ..... 135/20.1, 20.3, 21

See application file for complete search history.

(56) References Cited

U.S. PATENT DOCUMENTS

| | | | |
|---|---|---|---|
| 2,183,833 | A | 12/1939 | Farhar |
| 2,235,518 | A | 3/1941 | Goshaw |
| 2,475,406 | A | 7/1949 | Russell |
| 2,661,752 | A | 12/1953 | Kampf et al. |
| 2,670,133 | A | 2/1954 | Volker |
| 2,721,569 | A | 10/1955 | Militano |
| 2,724,396 | A | 11/1955 | Pereira |

(Continued)

FOREIGN PATENT DOCUMENTS

| | | | |
|---|---|---|---|
| CN | 2419864 | Y | 2/2001 |
| CN | 2441342 | Y | 8/2001 |

(Continued)

OTHER PUBLICATIONS

Machine Translation of CN 201197439, 8 pages Jul. 10, 2015.*

(Continued)

*Primary Examiner* — Robert Canfield

(74) *Attorney, Agent, or Firm* — Knobbe Martens Olson & Bear, LLP

(57) ABSTRACT

An umbrella is provided that has a transverse member mounted canopy control module. The umbrella has a support structure and a canopy. The support structure has a first support member having an upper end and a second support member. The second support member has a first end disposed adjacent to the first support member and a second end disposed away from the first end. The second support member extending along a longitudinal axis disposed transverse to the first support member. The canopy has an upper hub. The upper hub is coupled with the second support member. The umbrella also has an enclosure disposed at the first end of the second support member. A canopy control mechanism is at least partially disposed in the enclosure to alter the configuration of the canopy.

27 Claims, 7 Drawing Sheets

(56) References Cited

U.S. PATENT DOCUMENTS 2,905,187 A 9/1959 Croce
2,914,154 A 11/1959 Russell
3,120,238 A 2/1964 Glatz
3,129,715 A 4/1964 Fleischer et al.
3,142,307 A 7/1964 Danciart et al.
3,145,720 A 8/1964 Torii
3,150,671 A 9/1964 Frey
3,175,568 A 3/1965 Kafka
3,182,673 A 5/1965 Small
3,486,514 A * 12/1969 Prescott ..... 135/90
3,765,434 A 10/1973 Riggs
3,926,202 A 12/1975 Uthemann et al.
4,148,164 A * 4/1979 Humphrey ..... 52/94
4,582,078 A 4/1986 Ma
4,586,525 A 5/1986 Glatz et al.
4,606,366 A 8/1986 Collet
4,622,987 A 11/1986 Redl et al.
4,674,523 A 6/1987 Glatz
4,697,606 A 10/1987 Ma
4,878,509 A 11/1989 Tung
5,002,081 A 3/1991 Stromeyers
5,029,596 A 7/1991 Tung
5,086,797 A 2/1992 Earnshaw et al.
5,116,258 A * 5/1992 Vennik ..... 135/20.3
5,156,395 A 10/1992 Smith
5,161,764 A 11/1992 Roney
5,349,975 A 9/1994 Valdner
5,437,297 A 8/1995 Crisman et al.
5,492,232 A 2/1996 Ohm
5,499,644 A 3/1996 Geniele
5,584,564 A 12/1996 Phyle
5,611,364 A 3/1997 Woods et al.
5,678,585 A 10/1997 May
5,711,333 A 1/1998 Vanderminden, Sr.
5,735,302 A 4/1998 Saliva
5,785,069 A 7/1998 Glatz
D398,443 S 9/1998 Bolle
5,845,665 A 12/1998 Koehn
5,868,152 A 2/1999 Brown
5,871,024 A 2/1999 Vendermindern, Sr.
5,937,882 A 8/1999 Harbaugh
5,960,806 A 10/1999 Steiner
6,014,980 A 1/2000 Glatz
D434,215 S 11/2000 Lin
6,152,156 A 11/2000 Tung
D434,556 S 12/2000 Lin
6,209,147 B1 4/2001 Wheaton
6,220,261 B1 4/2001 Glatz
6,311,705 B1 11/2001 Ma
6,321,763 B1 * 11/2001 Ma ..... 135/20.1
6,330,886 B1 12/2001 Culver
6,435,444 B1 8/2002 Lin
6,446,650 B1 9/2002 Ma
6,478,037 B2 11/2002 Tung
6,520,192 B1 2/2003 Lo
6,571,403 B2 6/2003 Wheaton
6,575,182 B2 6/2003 Tung
6,575,183 B2 6/2003 Tung
D477,458 S 7/2003 Goldwitz
6,588,438 B1 7/2003 Steiner
6,607,002 B2 8/2003 Reese
6,619,306 B2 9/2003 Ma
6,662,815 B2 12/2003 Tung
6,761,180 B1 * 7/2004 Lai ..... 135/20.3
D497,479 S 10/2004 Yu
6,827,094 B1 12/2004 Bramwells
6,837,255 B2 1/2005 Bunch et al.
6,840,253 B2 1/2005 Ma
6,851,823 B2 2/2005 Bilotti
6,923,193 B2 8/2005 Chen
6,926,019 B2 8/2005 Glatz
6,945,263 B2 9/2005 Li
6,953,043 B2 10/2005 Yu
6,988,504 B1 1/2006 Goldwitz
D518,629 S 4/2006 Ma
7,108,388 B2 * 9/2006 Li ..... 362/102
7,134,442 B2 11/2006 Ma
7,207,343 B2 4/2007 Earnshaw et al.
7,255,118 B2 8/2007 Vardy et al.
7,341,068 B2 3/2008 Liu
7,398,790 B2 7/2008 Glatz
7,412,985 B2 8/2008 Ma
7,493,909 B2 2/2009 Ma
7,520,289 B1 4/2009 Barber
7,533,680 B2 5/2009 Ma
7,556,051 B2 7/2009 Lai
7,708,022 B2 5/2010 Ma
7,717,121 B2 5/2010 Glatz
D621,600 S 8/2010 He
7,866,331 B2 1/2011 Glatz
7,886,755 B2 * 2/2011 Tung ..... 135/21
7,913,707 B2 3/2011 Lai
7,918,054 B2 * 4/2011 Grafton et al. ..... 52/92.3
D638,622 S 5/2011 He
7,980,261 B2 7/2011 Glatz
8,066,021 B2 11/2011 Ma
8,104,492 B2 1/2012 Dan
8,113,223 B2 2/2012 Wang et al.
8,360,080 B2 1/2013 Liu et al.
8,522,804 B1 9/2013 Tung
2002/0083969 A1 7/2002 Tung
2002/0104557 A1 8/2002 Tung
2002/0129847 A1 * 9/2002 Ma ..... 135/98
2002/0174887 A1 * 11/2002 Reese ..... 135/20.1
2003/0010366 A1 1/2003 Glatz
2003/0015230 A1 1/2003 Glatz
2004/0031513 A1 2/2004 Bunch et al.
2004/0055627 A1 3/2004 Moga
2004/0055628 A1 3/2004 Yu
2004/0069333 A1 4/2004 Ma
2004/0177871 A1 9/2004 Harbaugh
2004/0182429 A1 9/2004 Chen
2004/0261827 A1 12/2004 Chen
2005/0013130 A1 * 1/2005 Li ..... 362/102
2005/0016571 A1 * 1/2005 Wu ..... 135/20.1
2005/0028852 A1 2/2005 Reese
2005/0041425 A1 * 2/2005 Li ..... 362/249
2005/0183762 A1 * 8/2005 Ma ..... 135/145
2005/0229957 A1 10/2005 Glatz
2005/0268952 A1 12/2005 Ma
2005/0268953 A1 * 12/2005 Ma ..... 135/20.3
2006/0081277 A1 * 4/2006 Liu ..... 135/20.1
2006/0169307 A1 8/2006 Lo
2006/0201542 A1 9/2006 Ma
2006/0243311 A1 * 11/2006 Glatz ..... 135/120.2
2006/0278262 A1 12/2006 Ma
2007/0074751 A1 4/2007 Fraser
2007/0163632 A1 7/2007 Chang
2007/0209688 A1 * 9/2007 Earnshaw ..... 135/16
2010/0051074 A1 3/2010 Dan
2010/0101614 A1 4/2010 Wang et al.
2010/0192997 A1 8/2010 Liu et al.
2010/0212705 A1 8/2010 Tung
2011/0005558 A1 * 1/2011 Lai ..... 135/20.1
2013/0092200 A1 * 4/2013 May ..... 135/20.1
2013/0333734 A1 12/2013 Ma
2014/0158173 A1 6/2014 Li et al.
2014/0166060 A1 * 6/2014 Ma ..... 135/20.3
2014/0230867 A1 8/2014 Ma
2014/0311537 A1 10/2014 Ma
2015/0059815 A1 * 3/2015 Xiong ..... 135/20.1

FOREIGN PATENT DOCUMENTS

CN 2621472 Y 6/2004
CN 2843147 Y 12/2006
CN 2896981 5/2007
CN 201001460 Y 1/2008
CN 201001463 Y 1/2008
CN 201076109 Y 6/2008
CN 201135192 Y 10/2008
CN 201197439 Y 2/2009
CN 201207982 Y 3/2009
DE 580503 7/1933

(56) References Cited

FOREIGN PATENT DOCUMENTS

| | | |
|---|---|---|
| DE | 2259192 | 6/1974 |
| DE | 3229776 | 4/1983 |
| DE | 3820573 | 8/1989 |
| DE | 297 12 024 | 9/1997 |
| DE | 299 06 116 | 8/1999 |
| DE | 20205561 | 7/2002 |
| DE | 10 2008 034 985 | 2/2010 |
| EP | 0 392 989 | 10/1990 |
| EP | 1 400 186 | 3/2004 |
| EP | 1 700 536 | 9/2006 |
| EP | 2 103 230 | 9/2009 |
| EP | 2 425 738 | 3/2012 |
| GB | 22218 | 9/1911 |
| WO | WO 97/04682 | 2/1997 |
| WO | WO 00/55456 | 9/2000 |
| WO | WO 2005/018369 | 7/2004 |

OTHER PUBLICATIONS

Operation Manual Easy Sun Parasol Sunshade (Issue: Jul. 2004) pp. 1-17.

Treasure Garden's product brochure identified as "AG3 9' Centilever Umbrella", p. 2.

Extended European Search Report issued in European Patent Application No. 14155827.0, dated Apr. 29, 2014, in 6 pages.

Extended European Search Report issued in European Patent Application No. 14183987.8, dated Oct. 15, 2014, in 6 pages.

Extended European Search Report issued in European Patent Application No. 14183979.5, dated Oct. 16, 2014, in 6 pages.

Extended European Search Report issued in European Patent Application No. 14185661.7, dated Feb. 4, 2015, in 8 pages.

Activa Leisure, 2010 Product Catalog, 65 pages.

Treasure Garden, 2010 Product Catalog, 94 pages copyright 2009.

* cited by examiner

CANTILEVER UMBRELLA

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

1. Field of the Invention

The invention relates to the field of shade structures, particularly umbrella and parasol devices and more particularly to an umbrella or parasol with a tilt feature.

2. Description of the Related Art

Umbrellas or parasols are devices which are typically utilized in an outdoor setting, such as in an outdoor patio, balcony, garden, cafe, and the like to provide shade and protection against the elements. Umbrellas or parasols generally include a canopy assembly that comprises a fabric-like material mounted over a plurality of support ribs. The support ribs can be collapsed7 into a storage position for the canopy assembly and can be deployed and supported in position to hold up and extend the fabric and thereby provides protection from the elements. The canopy assembly is generally supported from beneath or from above. Umbrellas supported from above have the advantage of providing space below the canopy where people can sit without the obstruction of a pole extending from below the canopy to the ground.

U.S. Pat. No. 6,840,253 discloses an umbrella supported from above, which includes a side post and side arm for supporting a canopy. The side arm, and thereby the canopy, can be rotated between specific positions by means of a drive bar that can be manipulated to both rotate the side arm and latch it in one of the positions. Thus, while this design provides some ability to tilt the canopy by rotation of its suspending side arm, that rotation can only be achieved between fixed latch positions and is therefore of limited convenience.

U.S. Pat. Nos. 6,152,156 and 6,478,037 to Tung disclose another variation of a sunshade with tiltable canopy, wherein a canopy assembly is suspended from above by an arcuate tube that is hingedly connected to a generally vertically extending support pole. Thus, by adjustment of the hinged interconnection between the arcuate tube and the vertical support pole, the canopy assembly of the Tung '156 and '037 devices can be tilted inwards and outwards from a generally vertically extending orientation. However, this construction appears to only offer a tilt in a single direction away from the generally vertical support pole.

Finally, U.S. Pat. No. 6,588,438 discusses a free-arm shade that has a radial shade ribs, support ribs attached to the shade ribs, and a shade rod slide that is freely attached to support ribs. It also has a decentral pole standing outside the shade. One of the shade ribs is vertically displaceably attached to pole by its outer end, and functions as a side arm. On its top side, the shade rib/side arm is connected to pole tip via an articulated rib. The shade rib/side arm has a pivot joint between the edge of the shade fabric and the pole. Articulated rib is connected to shade rib/side arm via a pivot hinge. Shade rib/side arm can be pivoted around the axis between pivot joint and pivot hinge. In the '438 patent, there is no clear provision for separate operation of the canopy, such as for opening and closing the shade.

SUMMARY OF THE INVENTION

There is a need for new cantilever umbrellas include more flexible operation of a canopy thereof. It would be an advance in the art to provide canopy operation mechanisms that change multiple aspects or configurations of the umbrella.

This application is directed to a cantilever umbrella having canopy controls mounted between a slide or runner and the canopy. In some cases, the mounting of the canopy controls shortens and/or straightens the path of a tension member to reduce the complexity and/or failure modes of the umbrella.

In one embodiment, an umbrella assembly is provided that includes a support pole and a canopy assembly. The support pole has a lower end and an upper end. The canopy assembly includes an upper hub that has a plurality of canopy fabric support ribs and a boom extending radially therefrom. The boom is disposed between two adjacent canopy fabric support ribs. The boom has a first end coupled with the hub and a second end disposed adjacent to the support pole. The umbrella also has a strut pivotally coupled with the support pole at the at an upper end and with the boom at a lower end. The umbrella also has a canopy adjustment module disposed between a moveable portion of the boom and the support pole. The canopy adjustment module has a housing, a shade angle mechanism disposed at least partially within the housing, and an opening and closing mechanism. The shade angle mechanism is configured to rotate the moveable portion of the boom about an axis thereof to displace an opening of the canopy from horizontal by an angle. The opening and closing mechanism is partially disposed within the housing and operable by a crank.

In another embodiment, a cantilever umbrella is provided that includes a support pole having a lower end and an upper end, a boom, and a canopy assembly. The boom is coupled with the support pole at an inner end and has an outer end disposed away from the support pole. The canopy assembly is coupled with the boom and has a housing disposed at the inner end of the boom. The housing has a locking device disposed therein for permitting rotation of a portion of the boom in a first configuration and for preventing rotation of the boom in a second configuration.

In another embodiment, an umbrella is provided that includes a support structure, a canopy, and an enclosure. The support structure has a first support member and a second support member. The first support member has an upper end. The second support member has a first end disposed adjacent to the first support member and a second end disposed away from the first end. The second support member extends along a longitudinal axis disposed transverse to the first support member. The canopy has an upper hub coupled with the second support member. The enclosure is disposed at the first end of the second support member and has a tilt mechanism locking device coupled therewith. The tilt mechanism locking device permits rotation of a portion of the second support member in a first configuration and prevents rotation of the second support member in a second configuration.

In some cases, the umbrella includes a canopy control mechanism includes a tilt mechanism coupled with a moveable portion of the boom, e.g., spaced away from the enclosure, to alter the angle of the canopy.

In some cases, the canopy control mechanism a canopy deployment mechanism disposed in the enclosure to open and close the canopy.

The enclosure can be disposed at the first end of the second support member. The enclosure can include a separable member. In some cases, the enclosure comprises a housing that may be separated to facilitate mounting the control mechanism therein.

In some embodiments, a plurality of locking components is provided. A first locking component is disposed on a tubular portion of a boom and a second locking component is provided on a housing of the umbrella. The first and second locking components can be moved away from each other to disengage. In an advantageous version, a spring is compressed when the locking components are disengaged. The spring urges the locking components to re-engage.

In some cases, indicia of the umbrella configuration are provided at the first end of the second support member. For example, a pointer can be mounted on one or both of the second support member and the enclosure. The pointer can point to a scale disposed on the second support member, the enclosure, or both the second support member and the enclosure.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments.

DETAILED DESCRIPTION OF THE PREFERRED EMBODIMENT

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein. Each and every feature described herein, and each and every combination of two or more of such features, is included within the scope of the present invention provided that the features included in such a combination are not mutually inconsistent.

Figure 1:
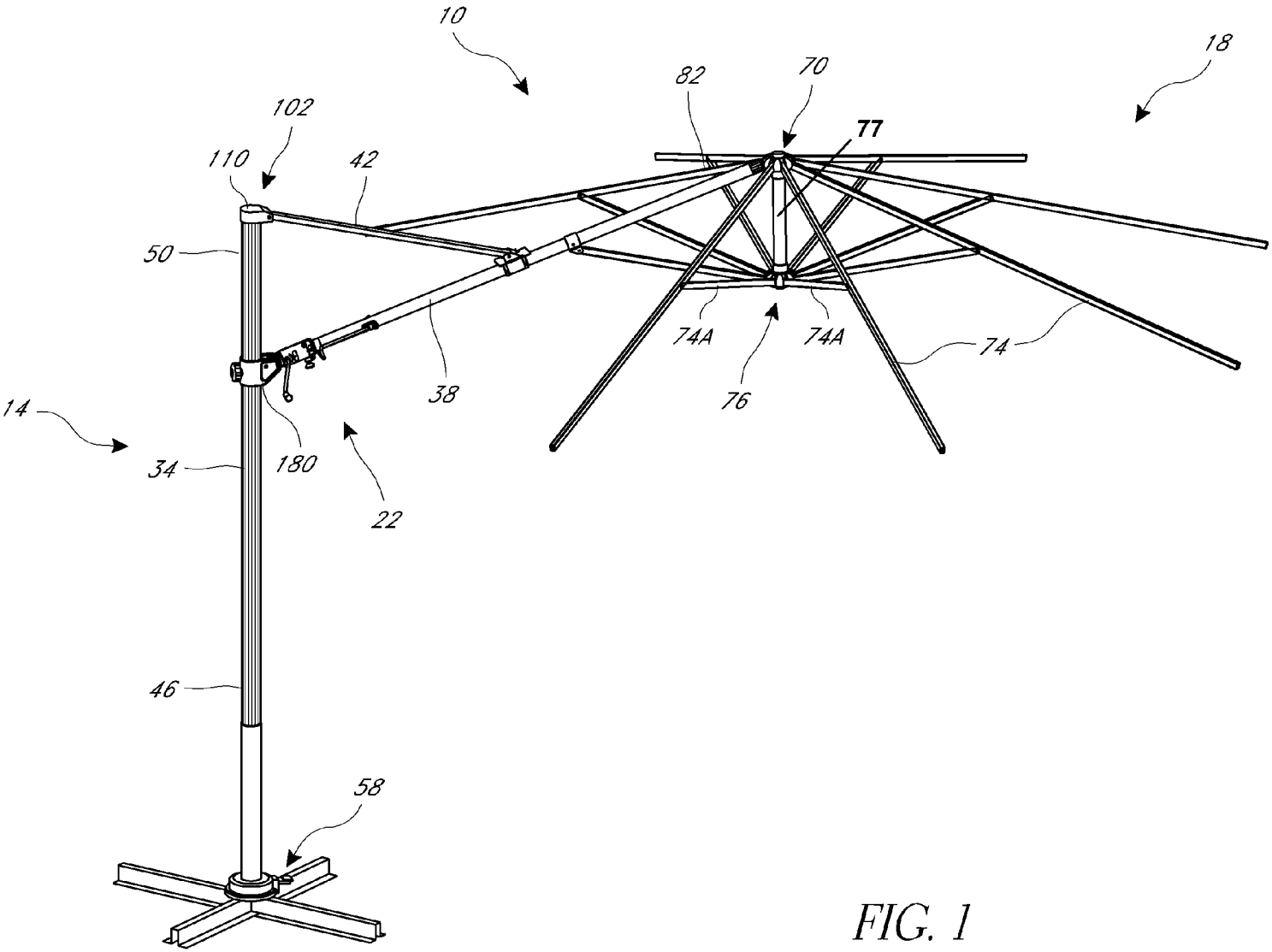
FIG. 1 is a side perspective view of an umbrella frame and pole assembly for an umbrella.
Figure 2:
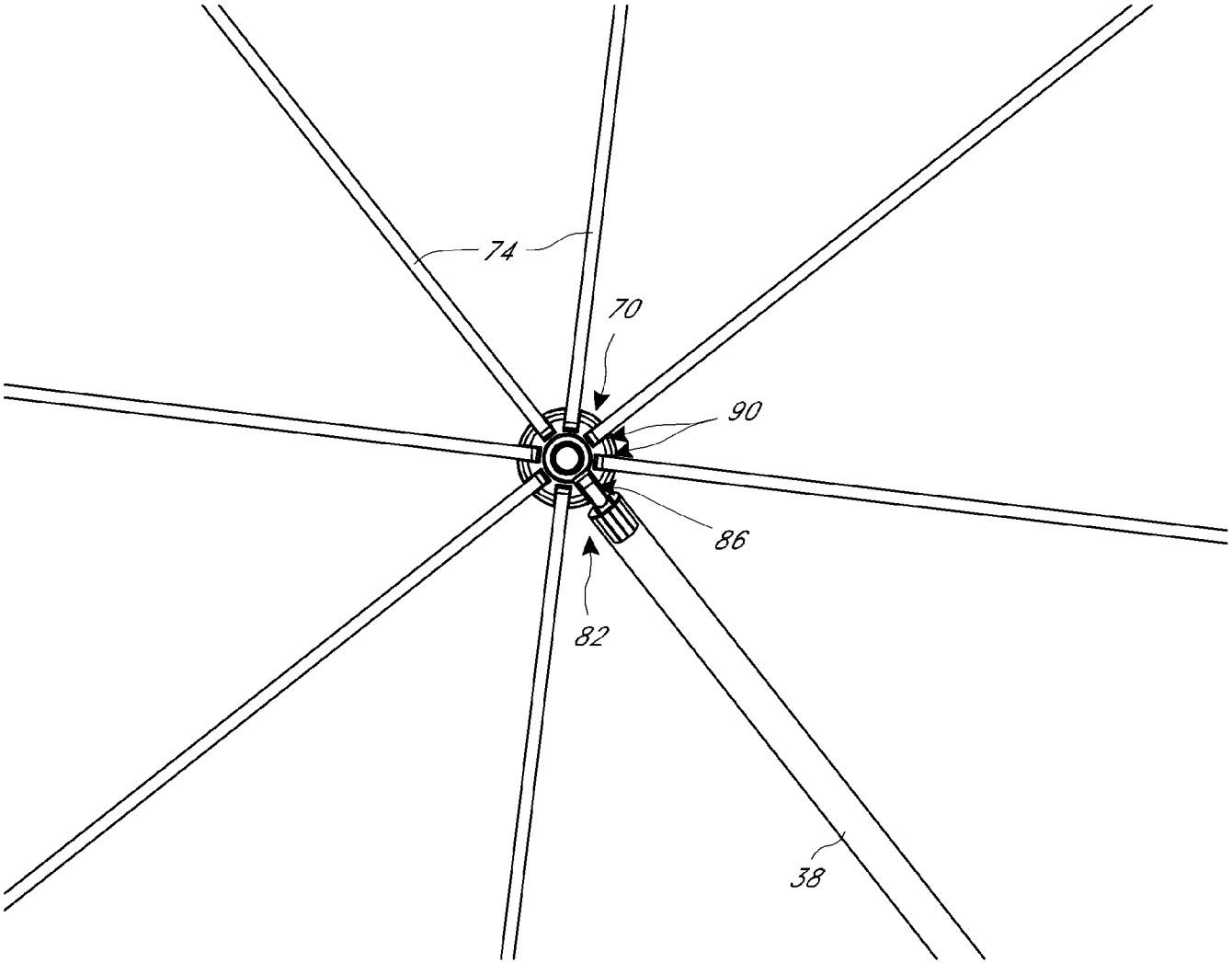
FIG. 2 is a top view of an upper portion of a canopy assembly of the umbrella of FIG. 1.

FIG. 1 illustrates one embodiment of an umbrella 10 that can be positioned in a variety of useful positions to provide shelter. The umbrella 10 includes a plurality of mechanisms to move a sheltering member, e.g., a canopy assembly or a canopy fabric, between the plurality of useful positions and also to open and close the canopy as much or as little as needed.

The umbrella 10 is provided that includes a support structure 14, a canopy 18, and a control module 22.

The support structure 14 can take a variety of forms. In one embodiment, the support structure 14 includes a support pole 34 and a strut 42 coupled with the support pole. The strut 42 and the support pole 34 also are coupled with a boom 38. The control module 22 is disposed at an end of the boom 38 adjacent to the pole 34 as discussed further below.

The support pole 34 has a lower end 46, an upper end 50 and an elongate body 54 extending therebetween. The pole can be configured to be mounted in a fixed position to the ground at or adjacent to the lower end 46. In some embodiments, it is desirable to permit the umbrella 10 to be moved. For example, a pivot device 58 can be provided at or adjacent to the lower end 46 to enable the pole 34 and the boom to rotate about a longitudinal axis of the pole 34. This permits up to 360 degree positioning of the pole 34. An example of a pivot device 58 is disclosed in U.S. Pat. No. 6,488,254 which is incorporated by reference herein in its entirety and enclosed in the appendix.

It may be desirable to move the umbrella 10 to different locations instead of or in addition to pivoting about a longitudinal axis of the longitudinal axis of the pole 34. For such applications, the lower end can be coupled with a moveable base, such as is described in U.S. Patent Publication No. 2012/0025050, in U.S. Patent Publication No. 2012/0024329, or in U.S. Patent Publication No. 2012/0024330. The moveable bases of U.S. Patent Publication No. 2012/0025050, in U.S. Patent Publication No. 2012/0024329, or in U.S. Patent Publication No. 2012/0024330 are hereby incorporated by reference herein in their entireties.

In one embodiment, the canopy assembly 18 has an upper hub 70 having a plurality of ribs 74 extending radially therefrom. The ribs 74 provide support to a canopy fabric (not shown) and stretch the fabric to keep it taught. A second set of ribs 74A extend from the ribs 74 to a lower hub 76 disposed below the upper hub 70. A member 77 is disposed between the upper and lower hubs 70, 76. The member 77 can be a tubular body configured to permit a tension member to extend down to the lower hub 76 and to draw the lower up into position relative to the upper hub 70 in the open configuration of FIG. 1. Each of the ribs of the second set of ribs 74A is pivotally attached to the lower hub 76. In one embodiment, one of the ribs 74A is coupled with the boom 38, e.g., pivotally attached to a flange 79 coupled with the arm. See FIG. 3.

The boom 38 also extends radially from the upper hub 70 in some embodiments. The boom 38 can be similar in construction at least at a first end 78 of the ribs 74. For example, the boom 38 can have a first end 82 disposed between two adjacent ribs 74 at a boom mounting location 86 of the upper hub 70. The boom mounting location 86 can have the same configuration as each of a plurality of rib mounting locations 90 of the upper hub. In one embodiment, the upper hub 70 is completely symmetrical and the rib and boom mounting locations 90, 86 are identical. This arrangement makes assembly easier in that any orientation of the upper hub 70 is acceptable. A second end 98 of the boom 38 is disposed adjacent to the support pole 34, as discussed further below.

The boom 38 has additional functions when compared with the ribs 74 and may be different from the ribs 74 at the first end 82 or at the second end 98. For example, the ribs 74 will generally have first ends coupled with the hub 70 and second ends spaced away from the hubs and not connected to other parts of the support structure 14. In contrast, the boom 38 may be coupled with the support pole 34 at the second end 98. As discussed below in more detail, the umbrella 10 is configured such that the boom 38 may rotate of the canopy 18 and may maintain the canopy at an angle other than horizontal.

The strut 42 preferably is pivotally coupled with the support pole 34 at an upper end 102 and with the boom 38 at a lower end 106. In one embodiment, the upper end 102 of the strut 42 is coupled with a cap 110 disposed at the upper end 50 of the support pole 34. The cap 110 is a bracket in one embodiment that can receive one or more pins that can also be coupled with the upper end 102 of the struts. The cap 110 may also have a decorative aspect, but generally is configured to be strong enough to support the boom 38 from above and to carry wind and other external loads to the upper end 102 of the pole 34.

Figure 3:
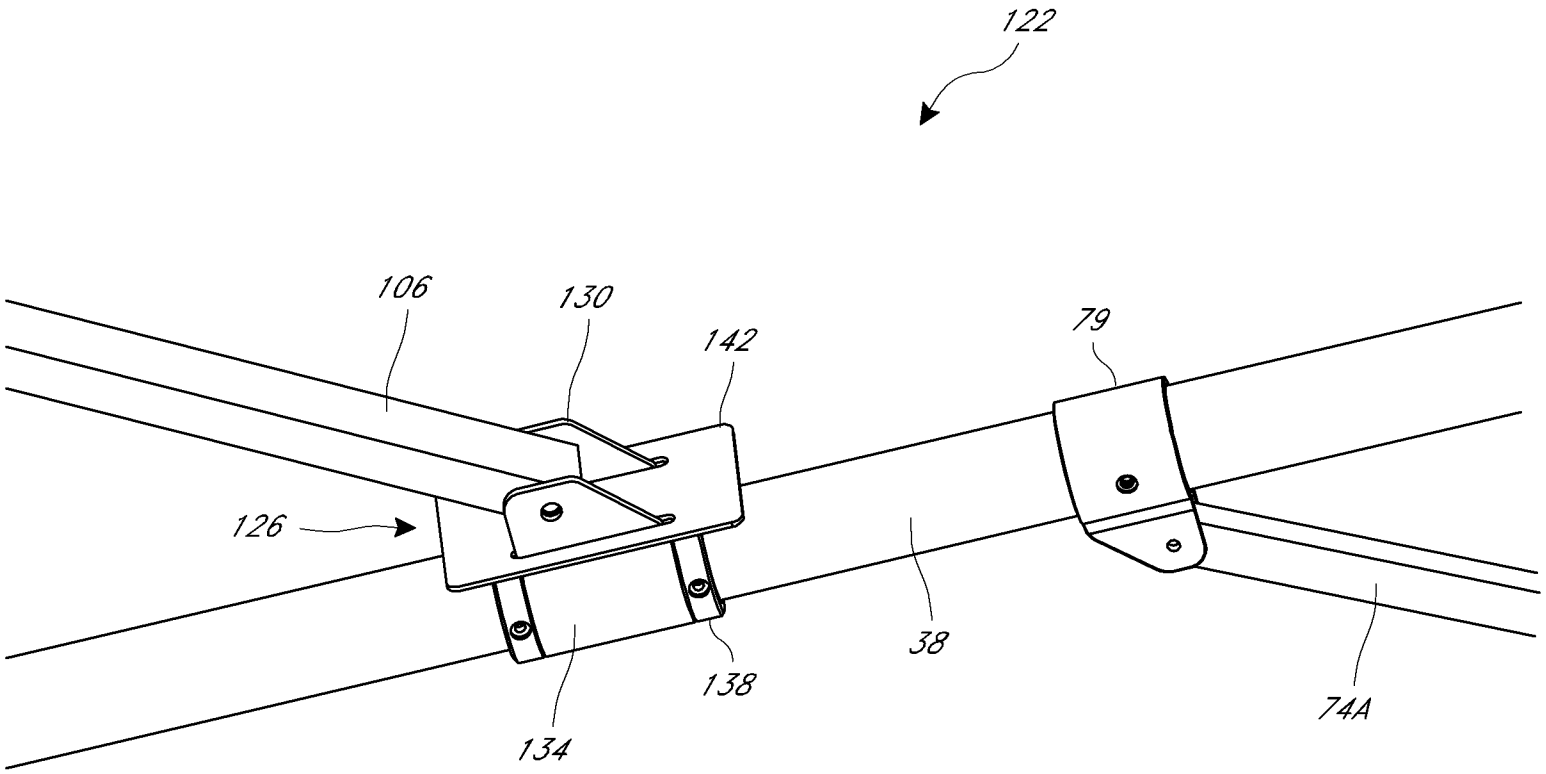
FIG. 3 is a perspective view of a pivot connection between a strut and a boom of the umbrella of FIG. 1.

FIG. 3 shows more detail of a pivot connection 122 between the lower end 106 of the strut 42 and the boom 38. The pivot connection 122 includes a bracket 126 with upright flanges 130 to which a pin is mounted. The bracket 126 also includes a bearing mount 134 which supports a bearing 138 or a plurality of bearings disposed on both sides of the bearing mount 134. The bearing(s) 138 facilitate pivoting of the boom 38 about a longitudinal axis of the boom. The inner surface of the bearing mount 134 preferably is circular in cross-section. The bearing 138 preferably has a circular outer surface. The bearing 138 and the bearing mount 134 can be any suitable combination of materials and structure that reduce friction to make operation of the umbrella easier. In one embedment, the bearing(s) 138 is directed connected to the boom 38 by one or more rivet. The pivot connection 122 may include a transverse flange 142 to which the upright flanges 130 are connected.

The control module 22 preferably is configured to make an adjustment to the canopy 18, and thus is sometimes referred to herein as a canopy adjustment module. The control module 22 preferably is disposed between the upper hub 70 and the support pole 34. In general, the control module 22 can be part of the boom 38 and/or can be affixed to or disposed on the boom 38. In other words, the control module 22 is mounted in the umbrella 10 such that it moves with the boom 38 but may be at a variety of positions relative to the support pole 34 depending on the operational condition of the umbrella. Generally the control module 22 remains disposed along the longitudinal axis of the boom 38, although the rotational orientation of the boom 38 may change as discussed below. This provides a significant advantage in that the components of the control module 22 can be simplified or made more robust by virtue of components of control mechanisms traversing a lower or no range of angles relative to the boom 38.

Figure 4:
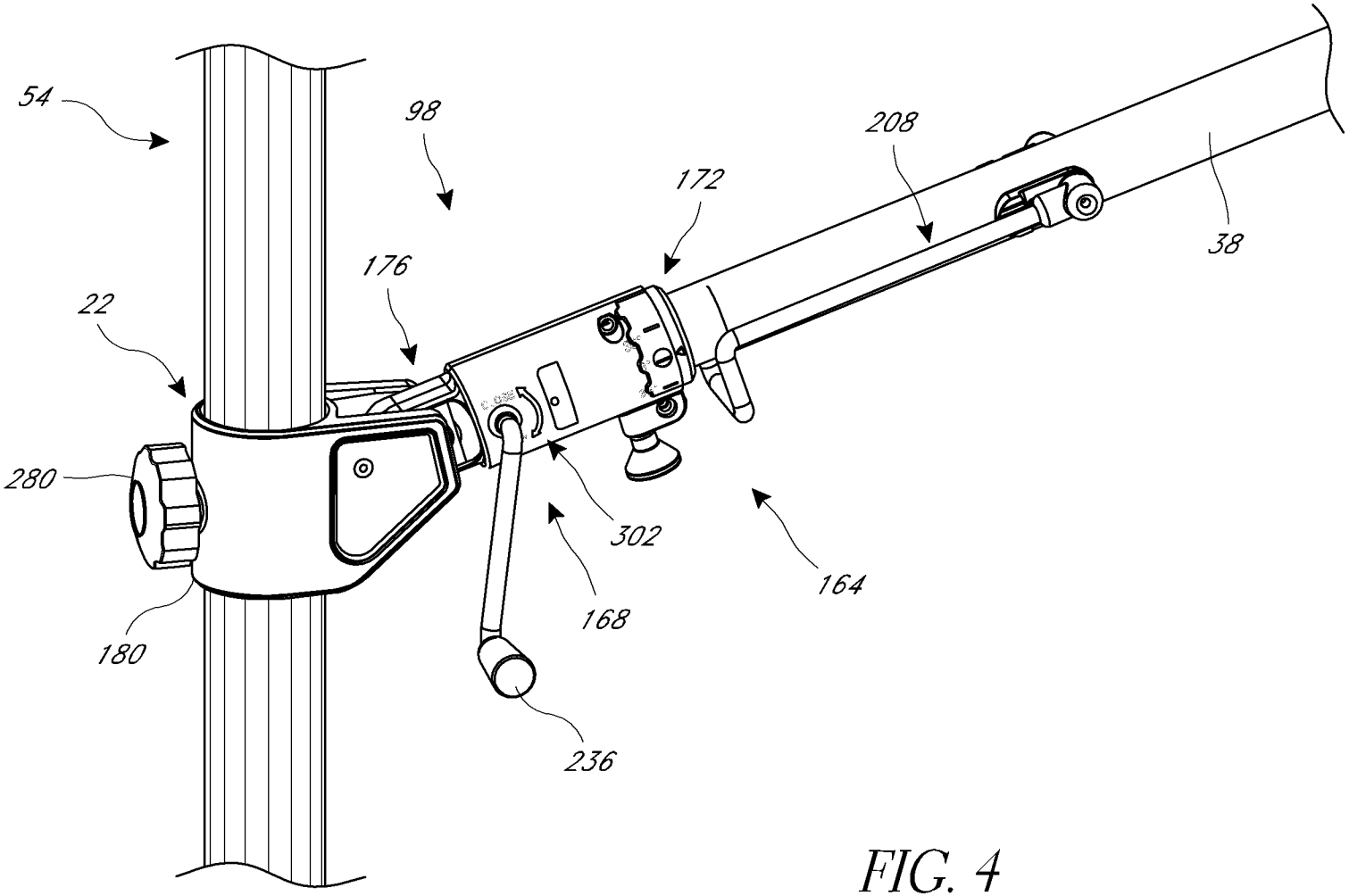
FIG. 4 is a close-up view of a runner or slide of the umbrella of FIG. 1, the slide being pivotally coupled with an arm having an umbrella control module.
Figure 5:
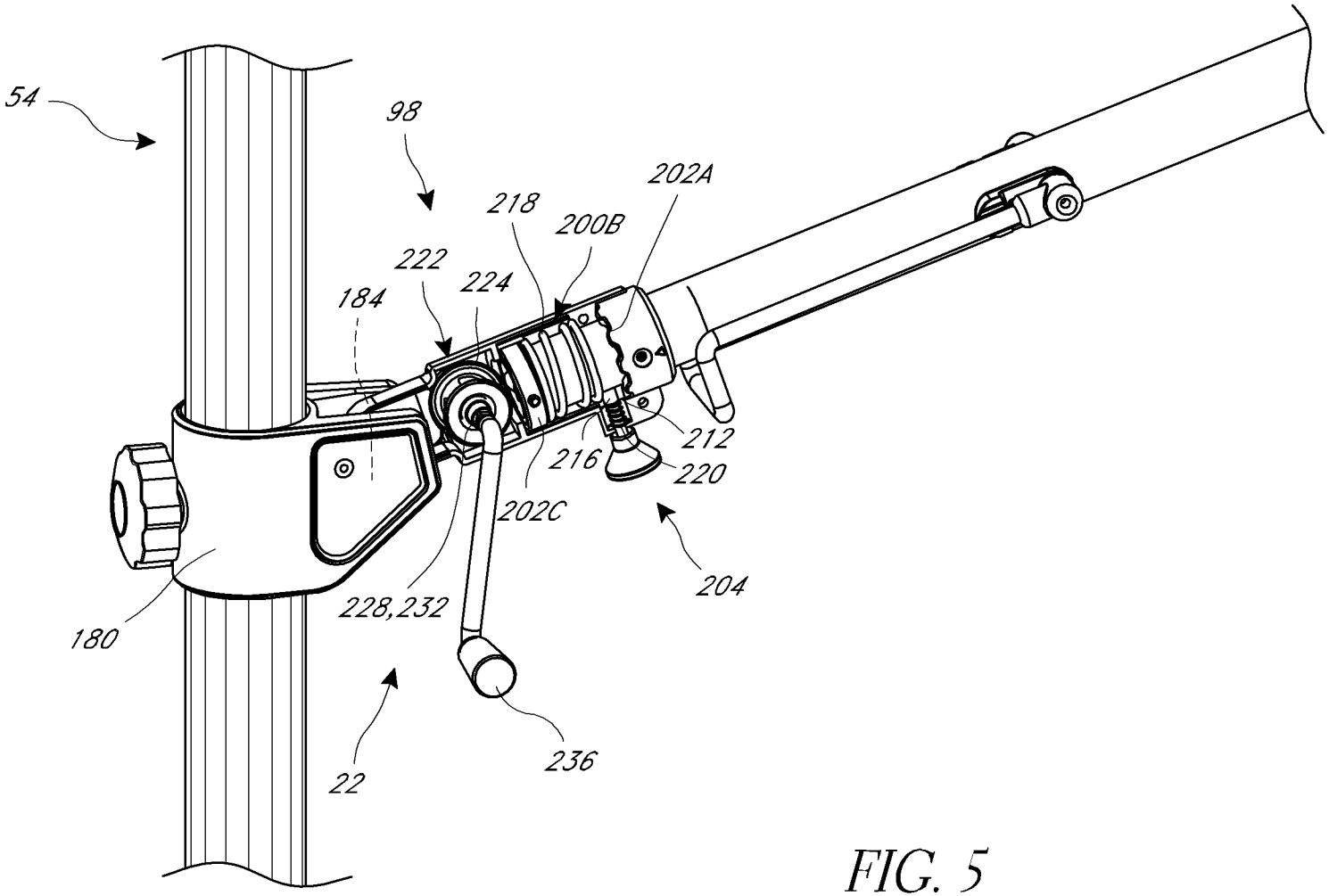
FIG. 5 is a view similar to that of FIG. 4, with a housing portion removed showing internal components.
Figure 6:
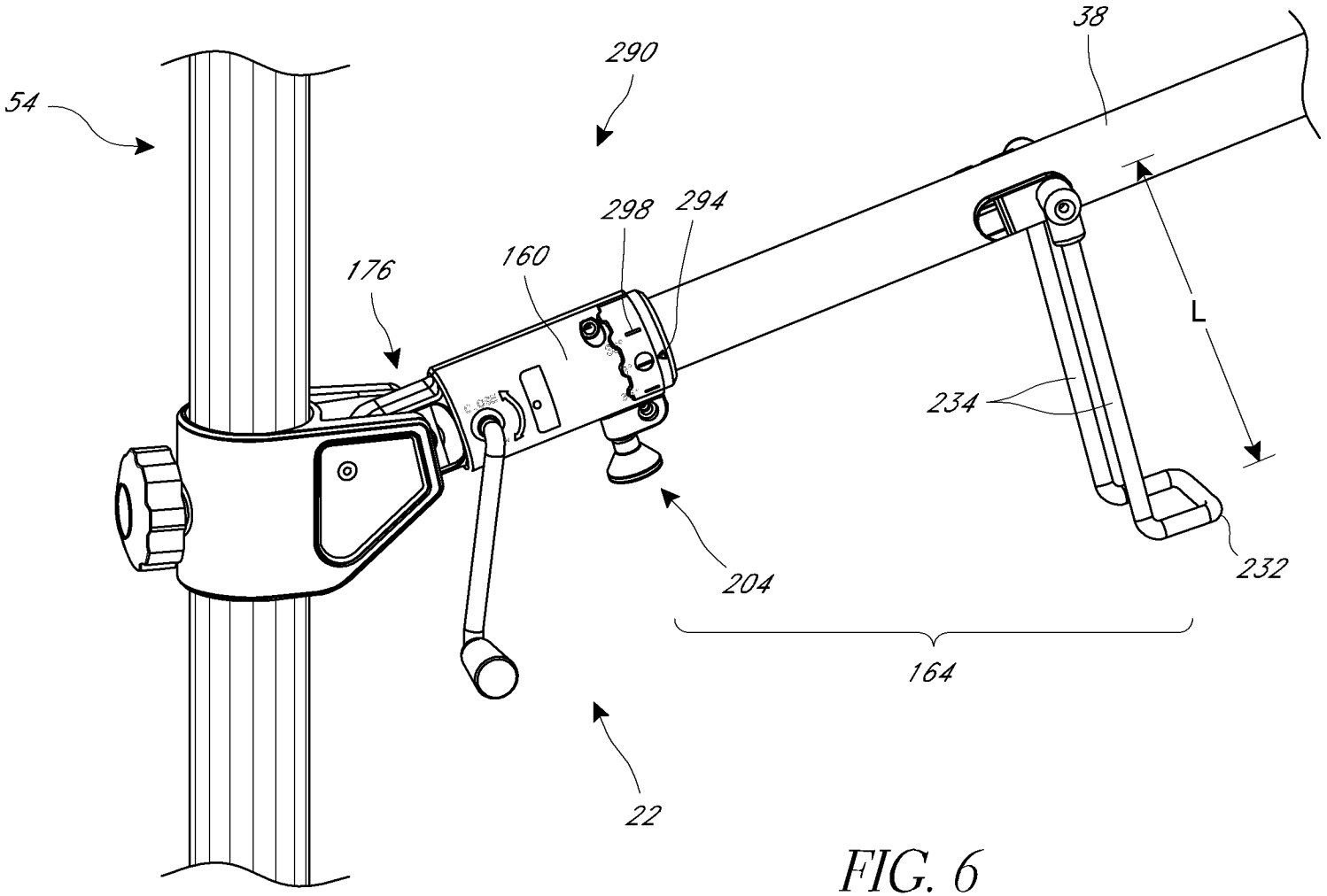
FIG. 6 is a view similar to FIG. 4 showing an actuating device in a deployed position.

With reference to FIGS. 4-6, the control module 22 can include a housing 160, a shade angle mechanism 164, and an opening and closing mechanism 168. The housing 160 can take any suitable form, but preferably has a first end 172 to be affixed to or to extend from the boom 38. In some embodiments, a second end 176 of the housing 160 is pivotally coupled with a slide 180. The slide 180 is configured to be moved by the user upward and downward on the support pole 34 along a range of positions, as discussed further below. Pivotal connection between the second end 176 of the housing 160 and the slide 180 is optional, e.g., if the boom 38 has just one position relative to the support pole 34, e.g., a fully extended position. Pivoting of the second end 176 of the housing relative to the slide 180 can be by any suitable structure, such as a simple pin 184 disposed transverse to the plane of movement through the second end and the slide.

Figure 5A:
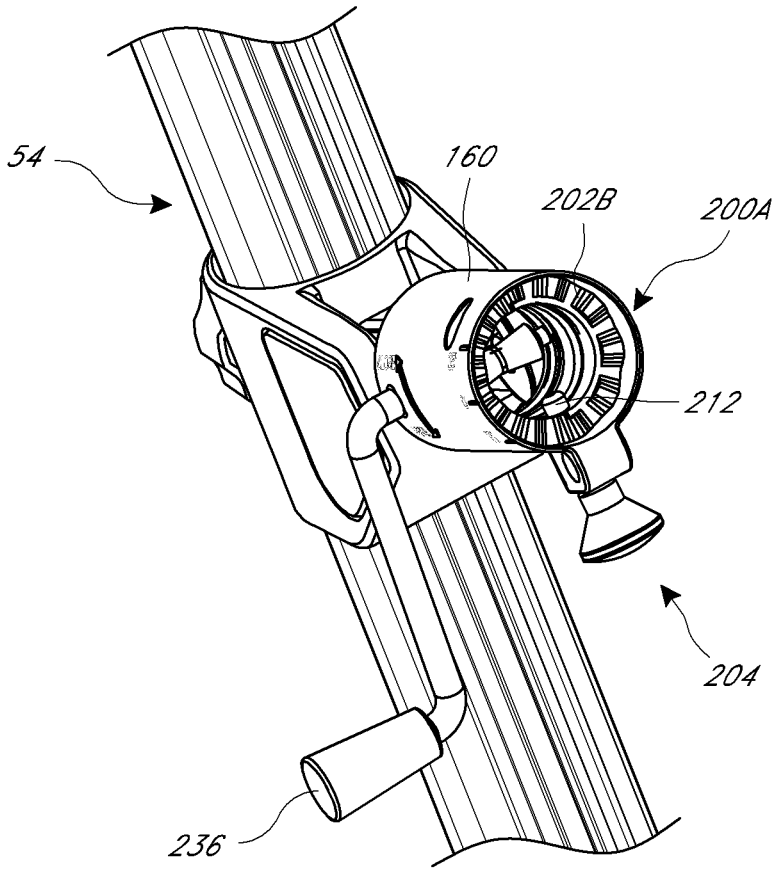
FIG. 5A is a detail view of a portion of a housing of the umbrella of FIG. 1 illustrating a locking component disposed in a recess thereof.

FIGS. 5-5A show that the housing 160 can have a concave structure or recess 200A at the first end 172. The recess 200A is sized to receive a hollow portion of the boom 38 that extends outward toward the hub 70. In one embodiment, the boom 38 also has a locking component 202A disposed thereon. The locking component 202A can be a ring-shaped member having one or a plurality of engagement features thereon. The engagement features can include a series of wave-like protrusions. The locking component 202A could be a gear with a plurality of gear teeth disposed on a side facing the pole 34. The recess 200A is larger than the hollow portion of the boom 38 by enough to provide clearance for an end of the tubular portion of the boom, and for the locking component 202A if provided. This permits the tubular portion of the boom 38 and the locking component 202A, if provided, to rotate within the recess 200A in the housing 160. For this reason, the housing 160 may be described as or considered a crank case in some variations.

FIG. 5A shows that the housing 160 can have a locking component 200B disposed in the recess 200A upon which the locking component 202A can act to lock the canopy 18 in a desired angle of inclination. The locking component 202B can be an arcuate shoulder formed on or disposed within the housing 160 having one or a plurality of engagement features thereon. The engagement features on the locking component 202B can include a series of wave-like protrusions that are configured to mesh with those of the locking component 202A. The locking component 202B could include a plurality of gear teeth disposed on the shoulder or in the recess, which can be a surface facing away from the pole 34 and facing the locking component 202A.

FIG. 5 shows that between the pivot mount at the pin 184 and the recess 200A, a space 200B can be formed in the housing. The space 200B can house a proximal end of the tubular member of the boom 38. The space 200B can be defined between a first shoulder located close to the locking components 202A, 202B and a second shoulder located between the first shoulder and the pin 184. The end of the tubular member of the boom 38 can have an enlargement 202C formed thereon. The enlargement 202C preferably has an outer profile that is larger than the inner profile of the first and/or the second shoulders disposed on ends of the space 200B. The enlargement 200C can be a ring mounted to the tubular member, then ring having a diameter that is larger than the inner periphery of, e.g. inner diameter of, the first and/or second shoulders. In one embodiment, the first shoulder is a side of the same shoulder comprising the locking component 202B. The space 200B has an inner profile that is larger than the outer profile of the enlargement 202C such that the enlargement can be displaced along the length of the space 200B. This movement is advantageous in enabling the locking components to completely or partially engage and disengage.

FIGS. 4-6 show that the shade angle mechanism 164 preferably is partially disposed in the housing 160. In one embodiment, the shade angle mechanism 164 includes a locking device 204 disposed in the housing 160 and an actuator 208 disposed on the boom 38. The actuator 208 rotates the boom 38 about a longitudinal axis thereof when the locking mechanism 204 is disengaged and the actuator 208 acted upon. In one form, the locking device includes a pin 212 mounted to the hosing 160 and configured to be withdrawn from one of a series of engagement features, which can be holes 216 formed in the hollow portion of the boom 38. In one embodiment, holes 216 are positioned at a neutral position and at +/−a selected number of degrees, e.g., +/−35 degrees. More than three holes 216 can be provided to permit a larger number of positions away from the neutral position. In one embodiment, the locking components 202A, 202B extending entirely around a periphery permitting a large range of tilt angles. A corresponding large number of holes 216 can be formed in the hollow portion of the boom 38. The pin 212 preferably has a coil spring 220 coupled therewith to cause the pin to automatically return to a locking position, e.g., in the one of the holes 216.

In one embodiment, the holes 216 are circular and have an inner diameter slightly larger than the outer diameter of the pin 212 such that movement of the boom 38 is minimized or eliminated when the pin engages a hole. In another embodiment, the width of the holes 216 as measured in the circumferential direction of the housing 160 or of the boom 38 is slightly larger than the diameter of the pin 212 but the holes have a length that is greater than the diameter of the pin. This arrangement permits some play in the locked configuration of the shade angle mechanism 164.

The shade angle mechanism 164 is configured to rotate the boom 38 about an axis of the boom when the pin 212 is disengaged from the holes 216 or other engagement features. With reference to FIG. 6, the actuator 208 can include a lever that can be deployed from a low profile position as in FIG. 4 to a high profile position as in FIG. 6. In the high profile position of FIG. 6, a gripping portion 232 is spaced away from the hollow tubular portion of the boom 38 by the length L of the actuator 208. The length L is sufficient to provide enough torque to enable any user to easily pivot the boom 38 about the longitudinal axis thereof toward a desired shade angle. Extension arms 234 are pivotally mounted to supports coupled with the boom 38 and extend to the gripping portion 232. Providing the additional torque by virtue of sizing the actuator 208 to have the length L is advantageous because the boom 38 and the umbrella canopy 18 can be very heavy, particularly where the shade area can reach 100 square feet or more.

The automatic return aspect of the locking device 204 allows the user to simply release the locking device 204 after it is disengaged from the holes 216 during a canopy pivoting maneuver. Once a spaced from neutral position is reached, the locking device 204 automatically advances the pin 212 into the hole 216 or other engagement features, locking the canopy 18 in a tilted from neutral position.

In order to further ease the use of the umbrella 10, the locking components 202A, 202B can be configured to automatically engage each other. In one embodiment, an energy storing device such as a spring 218 can be disposed between the tubular member of the boom 38 and the housing 160, e.g. in the space 200B. The spring 218 can have a first end abutting the enlargement 202C and a second end abutting the first shoulder of the space 200B. The spring 218 can be configured such that it is in a relaxed state when the locking components 202A, 202B are engaged. The neutral or zero position can correspond to a configuration where in the enlargement 202C is disposed close to the second shoulder of the space 200B. More generally, the spring 218 can be configured and positioned to urge the enlargement 202C toward the pole 34 relative to the housing 160. Upon actuating the actuator 208, the hollow portion of the boom 38 and the enlargement 202C are urged away from the support pole 34 and toward the first shoulder of the space 200B. During this movement, the locking components 202A, 202B disengage and the spring 218 is loaded such that strain energy is stored in the spring. After an angled position is provided by operating the actuator 208, the actuator may be released and the enlargement 202C translates back toward the second shoulder of the space 200B. This permits the locking components 202A, 202B to re-engage so that the angled position of the canopy 18 is maintained. In some embodiments, the locking components 202A, 202B are disposed in the space 200B and the spring 218 acts on other surfaces. For example, the spring 218 can be disposed between the second shoulder and the enlargement 202C in one embodiment.

Another advantage of the spring 218 is that it can provide a load absorbing function that can be important for certain embodiments. The umbrella 10 can be large and can be subject to significant loads, e.g., from wind gusts. While in inclement weather the umbrella 10 can be collapsed and stored, gusts are not predicable. A large gust could cause significant load to be focused on the pin 212. While the pin can be made of high strength materials, such focused loads could bend the pin 212 making it impossible to retract. Or the pin 212 could shear making the boom 38 less secure. The control module 22 can be configured however such that the spring 218 temporarily absorbs some or all of the load from such gusts to prevent a focused load from being applied to the pin 212. This protects the pin 212 from damage or breakage. To allow for the spring 218 to load, the holes 216 can be configured as slots, e.g., having a length and a width. The width of the holes 216 can be greater than the width such that the pin 212 can travel a distance in the holes 216 while the boom 38 remains at a selected angular orientation relative to the housing 160. Such travel induces a corresponding loading of the spring 218. The loading of the spring 218 is a temporary load absorbing by the control module 22. These are ways to configure the control module 22 with a load absorbing capability.

FIGS. 4-6 also show that the opening and closing mechanism 168 can be disposed in the housing 160 in various advantageous embodiments. For example, the housing 160 can include a space 222 disposed therein in which a spool 224 can be journaled for rotation. The spool 224 can be mounted on a shaft 228 that extends to an opening 232 in the housing 160. The shaft 228 can have an engagement feature 230 for coupling with a crank 236. In one embodiment, the crank 236 has a hand crank portion and an engagement feature coupling portion. The engagement feature coupling portion can have a square or other non-round profile to match a corresponding profile of the engagement feature.

A tension member (not shown) can extend from the spool 224, e.g., having a first end coupled with the spool, a second end coupled with the lower hub 76 of the canopy 18, and an intermediate portion disposed between the first and second ends of the tension member. In some cases, the tension member may be made of a material that is subject to wear. The embodiments discussed herein are extremely advantageous in such cases in that the tension member will not be required to traverse any angles between the support pole 34 and the boom 38. Moreover, the tension member will not have to traverse a boundary between the slide 180 and the boom 38 because the tension member does not extend to the slide. This is particularly advantageous in that the angle between the boom 38 and the slide 180 varies by a great deal from the upper to the lower extents of the range of motion of the slide.

The movement of the slide 180 between upper and lower positions can be facilitated by rollers (not shown) disposed between the support pole 34 and the slide. The rollers can be mounted to roll along a track formed on an outside surface of the pole. In some embodiments, the rollers act on opposing surfaces of the pole 34, e.g., with one or a plurality of rollers on a side of the pole from which the boom 38 extends and one or a plurality of rollers on a side of the pole opposite from where the boom extends.

A brake 280 preferably is provided on the slide 180 to allow the user to pick the height of the slide 180 along the support pole 34. The brake 280 thus enables the user to set the angle of the opening 228 of the canopy 18 from horizontal. The angle adjusted by movement of the slide 180 is either toward or away from the support pole 34. The brake 280 can take any suitable form, for example it can be a clamp causing compression of the housing 160 onto the support pole 34. The brake 280 can include a handle for advancing a friction plate against a surface of the support pole 34. The brake 280 can be configured as a pin and detent arrangement. In other embodiments, the brake 280 can include a pawl and ratchet arrangement and/or a cam clamp. All of these and other elevation securing means are contemplated to be among the various embodiments herein.

As noted above, one of the aspects of the umbrella to be controlled by the control module 22 is the angle of tilt of the opening 228 of the canopy 18 relative to a plane intersecting the support pole 34 and the center of the boom 38. If one views the umbrella along this plane with the support pole 34 between the point-of-view and the canopy 18 the tilting will be to the left and to the right of this plane. It is advantageous in various embodiments to provide a tile angle indicator 290 to indicate to the user how much tilt is provided. This is useful at least in that the user is generally not able to view the umbrella from the point-of-view just described while operating the shade angle mechanism 164. In one embodiment, the tilt angle indicator 290 comprises a pointer 294 mounted on an elongated tubular portion of the boom 38. The pointer 294 can be disposed adjacent to the housing 160. In some embodiments, it is useful to provide visual indicia of the degree of tilt. For example, visual indicia 298 can be provided on the housing 160 adjacent to the pointer 294. In one mode of use of the umbrella 10, as the boom 38 rotates the pointer 294 moves along the indicia 298. The indicia 298 indicate the tilt angle, e.g., the shade angle of the umbrella 10.

In some embodiments, the housing 160 includes indicia 302 of directions of greater and lesser open and close. The indicia 302 and the indicia 298 comprise control indicia indicating a plurality of forms of adjustment of the umbrella 10.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella assembly comprising:

a support pole having a lower end and an upper end;

a canopy assembly comprising an upper hub having a plurality of canopy fabric support ribs and a boom extending radially from points of connection located at a common elevation, the boom being disposed between two adjacent canopy fabric support ribs and having a first end coupled with the hub and a second end disposed adjacent to the support pole;

a strut pivotally coupled with the support pole at the at an upper end and with the boom at a lower end;

a runner moveably coupled with the support pole; and a canopy adjustment module disposed between a moveable portion of the boom and the support pole, the canopy adjustment module comprising:

a housing pivotably coupled with the runner;

a shade angle mechanism disposed at least partially within the housing and configured to rotate the moveable portion of the boom about an axis thereof to displace an opening of the canopy from horizontal by an angle; and an opening and closing mechanism partially disposed within the housing and operable by a crank journaled at a location spaced apart from the runner.

2. The umbrella assembly of claim 1, wherein the opening and closing mechanism comprises a spool and a tension member, the tension member having a first end coupled with the spool and a second end coupled with a lower hub of the canopy such that upon winding the tension member onto the spool, the lower hub is raised into a position close to the upper hub.

3. The umbrella assembly of claim 1, further comprising a brake configured to secure the runner to a position along its length of travel on the support pole.

4. The umbrella assembly of claim 1, wherein the canopy adjustment module further comprises a tilt angle indicator.

5. The umbrella assembly of claim 4, wherein the tilt angle indicator comprises a pointer mounted on the moveable portion of the boom.

6. The umbrella assembly of claim 5, wherein the pointer is disposed adjacent to the housing and further comprising visual indicia on the housing adjacent to the pointer.

7. The umbrella assembly of claim 1, wherein the housing comprises canopy control indicia indicating a plurality of forms of adjustment.

8. The umbrella assembly of claim 1, wherein the housing is coupled with the support pole in a manner permitting the canopy adjustment module to be raised and lowered along the support pole.

9. The umbrella assembly of claim 1, wherein the canopy adjustment module comprises a load bearing element disposed between the housing and the boom.

10. An umbrella assembly comprising:

a support pole having a lower end and an upper end;

a canopy assembly comprising an upper hub having a plurality of canopy fabric support ribs and a boom extending radially therefrom, the boom being disposed between two adjacent canopy fabric support ribs and having a first end coupled with the hub and a second end disposed adjacent to the support pole;

a strut pivotally coupled with the support pole at the at an upper end and with the boom at a lower end; and a canopy adjustment module disposed between a moveable portion of the boom and the support pole, the canopy adjustment module comprising:

a housing;

a shade angle mechanism disposed at least partially within the housing and configured to rotate the moveable portion of the boom about an axis thereof to displace an opening of the canopy from horizontal by an angle; and an opening and closing mechanism partially disposed within the housing and operable by a crank;

wherein the shade angle adjustment mechanism includes a locking device disposed on the housing and an actuator coupled with the moveable portion of the boom.

11. The umbrella assembly of claim 10, wherein the locking device includes a pin and plurality of recesses formed in the boom, the pin being capable of being engaged or disengaged from the recesses.

12. The umbrella assembly of claim 10, wherein the locking device includes a pair of locking components disposed adjacent to each other, the umbrella being configured to dispose the locking components in locked an unlocked configurations.

13. The umbrella assembly of claim 12, wherein the umbrella is configured to provide relative motion between the locking components along an axis of the boom between locked and unlocked configurations.

14. An umbrella assembly comprising:

a support pole having a lower end and an upper end;

a canopy assembly comprising an upper hub having a plurality of canopy fabric support ribs and a boom extending radially therefrom, the boom being disposed between two adjacent canopy fabric support ribs and having a first end coupled with the hub and a second end disposed adjacent to the support pole;

a strut pivotally coupled with the support pole at the at an upper end and with the boom at a lower end; and a canopy adjustment module disposed between a moveable portion of the boom and the support pole, the canopy adjustment module comprising:

a housing;

a shade angle mechanism disposed at least partially within the housing and configured to rotate the moveable portion of the boom about an axis thereof to displace an opening of the canopy from horizontal by an angle; and an opening and closing mechanism partially disposed within the housing and operable by a crank;

wherein the shade angle mechanism comprises a lever coupled with the moveable portion of the boom.

15. The umbrella assembly of claim 14, wherein the lever comprises a deployed configuration and a stored configuration.

16. The umbrella assembly of claim 14, wherein the lever is pivotally connected to the moveable portion of the boom at a first end and comprises a handle at a second end.

17. The umbrella assembly of claim 16, wherein the lever is pivotally connected to the moveable portion of the boom at two opposing locations, the handle being disposed between the first and second locations.

18. A cantilever umbrella comprising:

a support pole having a lower end and an upper end;

a boom coupled with the support pole at an inner end and having an outer end disposed away from the support pole;

a canopy assembly coupled with the boom;

a housing disposed at the inner end of the boom, the housing having a locking device disposed therein for permitting rotation of a portion of the boom about a longitudinal axis thereof in a first configuration and for preventing rotation of the boom in a second configuration; wherein the housing comprises a spool and tension member disposed therein for opening and closing the canopy.

19. The cantilever umbrella of any of claim 18, further comprising a strut having an upper end pivotally coupled with an upper end of the support pole and a lower end pivotally coupled with the boom.

20. The cantilever umbrella of claim 19, further comprising a bearing coupled with lower end of the strut, the bearing permitting rotation of the boom about an axis of the boom.

21. The cantilever umbrella of claim 18, wherein the boom is coupled with the support pole for inward and outward movement of the outer end and upward and down movement of the inner end.

22. The cantilever umbrella of claim 21, further comprising a runner pivotally coupled with the housing and configured to travel upward and downward on the support pole.

23. The cantilever umbrella of claim 22, further comprising a brake disposed between the runner and the support pole for selectively fixing the runner to the support pole.

24. The cantilever umbrella of claims 18, wherein the boom is coupled with a rib mounting location of an upper hub of the boom.

25. The cantilever umbrella of claim 18, further comprising a spring coupled with the housing and with the boom to store and release loads directed from the boom toward the housing.

26. An umbrella comprising:

a support structure comprising:

a first support member having an upper end;

a second support member having a first end disposed adjacent to the first support member and a second end disposed away from the first end, the second support member extending along a longitudinal axis disposed transverse to the first support member;

a canopy comprising an upper hub and ribs radiating from the upper hub, the upper hub coupled with the second support member at the same elevation as the ribs;

an enclosure disposed at and at least partially surrounding the first end of the second support member having a tilt mechanism locking device coupled therewith, the tilt mechanism locking device being retractable out of the second support member to permit rotation of a portion of the second support member in a first configuration and being insertable into the second support member to prevent rotation of the second support member in a second configuration.

27. The umbrella of claim 26, wherein the enclosure houses a portion of a canopy deployment mechanism configured to open and close the canopy.

* * * * *